United States Patent [19]

Rakowicz et al.

[11] 4,048,950

[45] Sept. 20, 1977

[54] DEVICES FOR APPLYING ADHESIVES TO A MOVING WEB

[75] Inventors: Jan Antoni Rakowicz; Brian Harrison, both of London, England

[73] Assignee: Molins Limited, England

[21] Appl. No.: 627,280

[22] Filed: Oct. 30, 1975

[30] Foreign Application Priority Data

Nov. 2, 1974 United Kingdom ..... 47481/74

[51] Int. Cl.[2] ..... B05C 5/02

[52] U.S. Cl. ..... 118/6; 118/7; 118/411

[58] Field of Search ..... 118/410, 411, 412, 6, 118/235, 7, 419; 401/262; 222/558

[56] References Cited

U.S. PATENT DOCUMENTS

| | | | |
|---|---|---|---|
| 224,656 | 2/1880 | Craig | 118/412 |
| 2,030,609 | 2/1936 | Quittner | 222/558 X |
| 2,349,256 | 5/1944 | Evans | 118/411 |
| 2,558,084 | 6/1951 | Gwinn | 118/411 |
| 2,727,488 | 12/1955 | Nerim | 118/411 X |
| 3,224,411 | 12/1965 | Blaha et al. | 118/411 X |
| 3,416,491 | 12/1968 | Turnbull et al. | 118/411 |
| 3,885,518 | 5/1975 | Varni | 118/235 X |

*Primary Examiner*—John P. McIntosh
*Attorney, Agent, or Firm*—Craig & Antonelli

[57] ABSTRACT

A device for applying adhesive to a moving web, comprises a nozzle against which the web is arranged to run and from which adhesive is delivered, and a closure member which is movable between a position in which it allows the web to run against the nozzle and a position in which it moves the web away from the nozzle and lies against the nozzle so as to stop the flow of adhesive from the nozzle.

11 Claims, 4 Drawing Figures

DEVICES FOR APPLYING ADHESIVES TO A MOVING WEB

This invention is particularly concerned with applying adhesive to the web of material, known as "cork", which is used to join cigarette filters to the tobacco-filled parts of the cigarettes. However, the invention could also be used to apply liquids other than adhesives to a moving web. For convenience, however, the liquid which is applied to a web will be referred to in this context as an "adhesive".

According to one aspect of this invention, a device for applying adhesive to a moving web comprises a nozzle against which the web is arranged to run and from which adhesive is delivered, and a closure member which is movable between a position in which it allows the web to run against the nozzle and a position in which it moves the web away from the nozzle and lies against the nozzle so as to stop the flow of adhesive from the nozzle.

Preferably the adhesive is delivered to the nozzle through a passageway having an outlet to an expansion chamber, for example in the form of a bellows, which is expanded momentarily so as to reduce the pressure of the adhesive in the nozzle (and preferably stop the flow altogether) during the interval of time following the moving of the web away from the nozzle and before the closure member engages the nozzle so as to close it.

In a preferred arrangement for use in applying adhesive to cork web in a filter attachment machine, the nozzle is elongated, and the closure member includes a roller having its axis parallel to the nozzle. Preferably the roller has a resilient outer surface, for example formed by a sleeve of flexible material, which is slightly deformed when the roller is in position against the nozzle to ensure that the nozzle is tightly closed. The roller may rotate on a member which carries a plate by which the web is moved away from the nozzle as the roller approaches the nozzle.

According to another aspect of this invention, a nozzle device for applying adhesive to a moving web includes an external closure member for closing the nozzle when adhesive is not required, and has a supply passage through which adhesive is passed to the nozzle and which includes an outlet to an expansion chamber which is automatically expanded so as to reduce the pressure of adhesive in the nozzle (and preferably stop the flow of adhesive altogether) immediately adhesive is no longer required to pass from the nozzle, that is to say between the interval of time following this requirement and before the closure member has moved to close the nozzle.

An example of a nozzle for applying adhesive to the cork web in a filter attachment machine is shown in the accompanying drawings.

Figure 1:
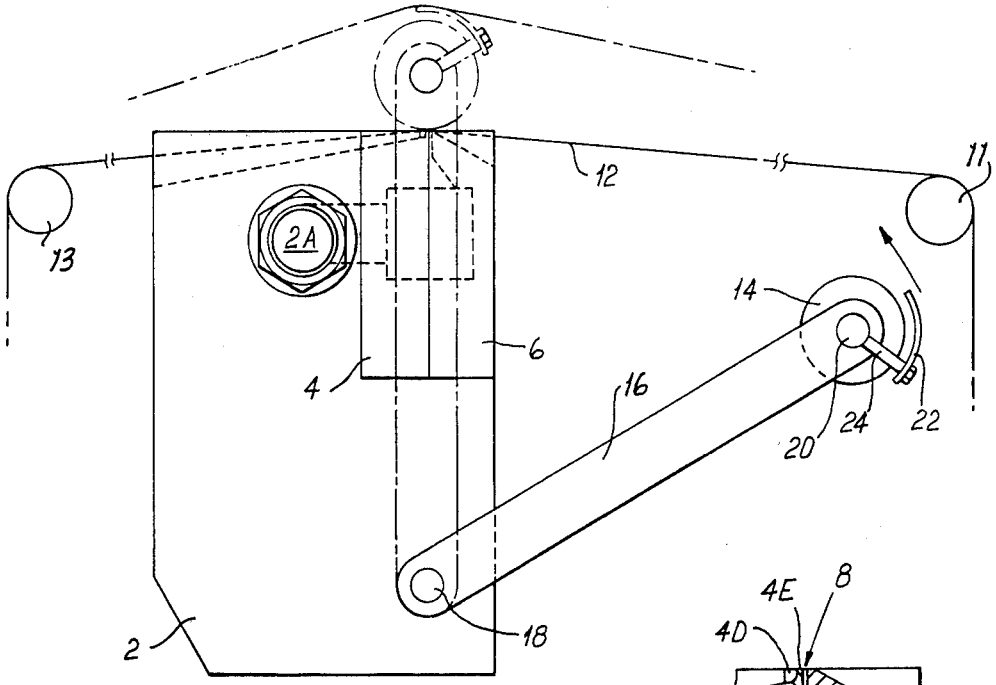
FIG. 1 is a side elevation of the nozzle.

The nozzle includes a main body 2 to which members 4 and 6 are attached, for example by bolts (not shown). Adhesive is delivered into a passageway 2A in the body 2 from a delivery member 7 (FIG. 2) which is described further on in more detail. From the passageway 2A the adhesive passes into a port 4A in the member 4 leading to a groove 4B. In the opposed face of the member 6 there is a groove 6A; the grooves 4B and 6A together define a chamber adjacent to a nozzle outlet 8 which is defined between the members 4 and 6.

Figure 3:
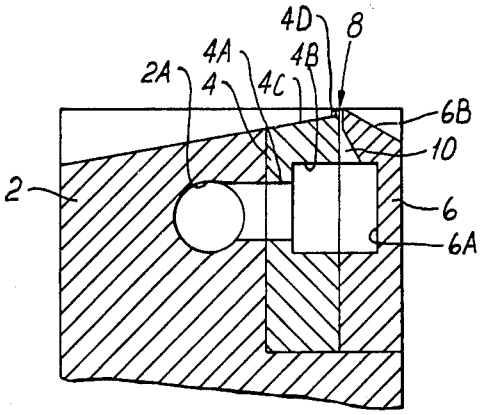
FIG. 3 is a fragmentary section on the line III—III in FIG. 2.
Figure 2:
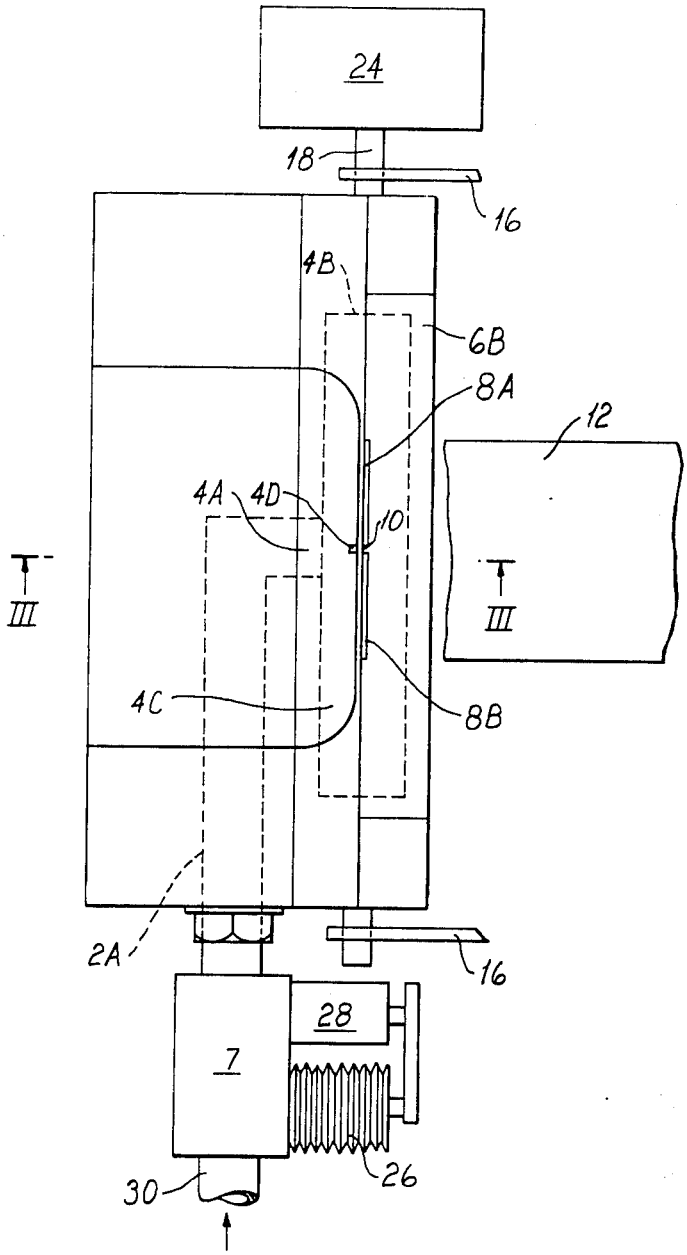
FIG. 2 is a plan view of the nozzle.

As shown particularly in FIG. 2, the nozzle outlet 8 comprises two narrow slits 8A and 8B separated by a rib 10 in the member 6. The slits are formed by machining away part of the member 6, which is further machined internally to the cross-section shown in FIG. 3. A cork web 12 is fed via guide means 11 and 13 along a path which bends slightly around the nozzle outlet, so that the web is pressed against the nozzle as a result of the tension in the web. The rib 10 separating the parts 8A and 8B of the nozzle outlet is provided so that substantially no adhesive is applied along a narrow central "dry line" on the cork; the reason for this is that the completed assembly formed by joining two tobacco rods to opposite ends of a double-length filter by means of a section of the web 12 is finally cut through the middle to form two separate filter-tipped cigarettes, and it is desirable to avoid bringing the knife coming into contact with adhesive as far as possible. Furthermore, the upper surface of the member 4 is machined away to provide a downwardly sloping surface 4C in the region of a web, but leaving a short, narrow rib 4D which helps to wipe off any adhesive which may spread onto the dry line.

Figure 4:
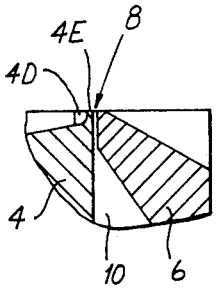
FIG. 4 is an enlargement of part of FIG. 3.

As shown in FIG. 4, the upper surface of the member 4 is cut away in the region of the web so as to leave a narrow lip 4E having a vertical face on its downstream side (i.e., downstream of the nozzle outlet). This helps to ensure the even application of adhesive to the web and helps to avoid any build-up of adhesive on the outer surface of the nozzle itself.

The member 6 is cut away in the region of the web to provide a downwardly sloping surface 6B which is well clear of the web.

A closure member in the form of a roller 14 of resilient plastics material (e.g., nylon) is carried by two arms 16 mounted on a spindle 18 which passes through the body 2. The roller 14 is rotatable on a spindle 20 fixed to the arms 16. The spindle 20 also carries a lifting plate 22 via a pair of posts 24.

The roller is shown in FIG. 1 in solid outline in a position in which it allows the web 12 to run against the nozzle. When the machine is stopped, or when the nozzle is required to be closed for any other reason, the roller is moved into contact with the nozzle by means of an operating device 24 (shown diagrammatically in FIG. 2) which rotates the spindle 18 in a counterclockwise direction as viewed in FIG. 1. As the roller moves upwards, the lifting plate 22 first lifts the web 12 from the nozzle (to the position shown in a chain dotted line), and the roller then rolls into a position in which it closes the nozzle outlet. When the nozzle is again required to deliver adhesive to the web, the roller is returned by the device 24 to the position shown in solid outline in FIG. 1, thus automatically opening the nozzle and lowering the web onto the nozzle.

A liquid adhesive, for example PVA, is delivered to the body 2 via a delivery member 7 which has an outlet to an expansion chamber in the form of a bellows 26. The bellows is expanded automatically by a pneumatic jack 28 as soon as the lifting plate 22 begins to lift the web 12 from the nozzle; this avoids any further delivery of adhesive from the nozzle outlet during the short period before the outlet is closed by the roller.

The adhesive is preferably supplied to the body 2 at a relatively low pressure (e.g. 1½ to 5 psi) by a positive displacement pump, for example a peristaltic pump. In that case, in order to reduce or avoid pressure pulsing of adhesive, the pipe 30 leading to the delivery member 7 may include two axially spaced restrictors, with an expansion chamber which communicates with the space between the restrictors; for example, the expansion chamber may comprise a second pipe which has one end connected to the pipe 30 and is arranged to trap a column of air at its other end, so that the adhesive can expand into the second pipe during pressure pulses, at the same time compressing the air column. The end of the second pipe containing the air column may have a normally closed vent which can be opened to allow some air to escape if the resilience of the air column is required to be increased.

We claim:

1. A device for applying adhesive to a moving web, comprising a nozzle against which the web is arranged to run and from which adhesive is to be delivered, guide means for feeding the web along a path which bends around the nozzle, a closure member which is mounted on the same side of the said path as the nozzle, and means for moving the closure member between a position in which it allows the web to run against the nozzle and a position in which it holds the web away from the nozzle and lies against the nozzle so as to stop the flow of adhesive from the nozzle.

2. A device according to claim 1 in which the nozzle is elongated and in which the closure member includes a roller which has its axis parallel to the nozzle and is arranged to engage the nozzle to stop the flow of adhesive from the nozzle.

3. A device according to claim 2 in which the roller has a resilient outer surface which is slightly deformed when the roller is in position against the nozzle to ensure that the nozzle is tightly closed.

4. A device according to claim 2 in which the roller is carried by an arm which is pivotally movable about an axis parallel to the nozzle and to the axis of the roller.

5. A device according to claim 2 for applying adhesive to a web used to join two tobacco rods to opposite ends of a double-length filter to form an assembly which is then cut in half to form two filter-tipped cigarettes, in which the nozzle comprises two slits separated by an intervening rib to produce a central dry line on the web on which substantially no adhesive is deposited.

6. A device according to claim 1 in which the closure member includes a plate which is arranged to lift the web from the nozzle as the closure member approaches the nozzle.

7. A device according to claim 1 in which the adhesive is delivered to the nozzle via a passageway having an outlet to an expansion chamber, and including means for momentarily expanding the expansion chamber so as to reduce the pressure of the adhesive in the nozzle during the interval of time following the moving of the web away from the nozzle and before the closure member engages the nozzle so as to close it.

8. A device according to claim 7 in which the expansion of the expansion chamber is sufficient to stop the flow of adhesive from the nozzle during the said interval of time.

9. A nozzle device for applying adhesive to a moving web, including means for lifting the web from the nozzle, an external closure member for closing the nozzle, means defining a supply passage through which adhesive is to be passed to the nozzle and which includes an outlet, an expansion chamber which communicates with the outlet, and means for automatically expanding the expansion chamber so as to reduce the pressure of adhesive in the nozzle during the interval of time following the moving of the web away from the nozzle and before the closure member engages the nozzle so as to close it.

10. A device according to claim 9 in which the expansion of the expansion chamber is sufficient to stop the flow of adhesive from the nozzle during the said interval of time.

11. A device for applying adhesive to a web used to join two tobacco rods to opposite ends of a double-length filter to form an assembly which is then cut in half to form two filter-tipped cigarettes, comprising an elongated adhesive supply nozzle against which the web is to run with the nozzle lying across the web, a closure member for the nozzle comprising a resilient roller arranged with its axis equal to the length of the nozzle, the roller being carried by a carrier member pivoted about a fixed axis which is parallel to the axis of the roller and is at a distance from the latter axis such that the roller is resiliently compressed on being carried by said carrier member to a position in which it closes the nozzle, and a lifting plate mounted on the pivotally mounted member at a distance from the axis of rotation of the said member which is greater than the distance of the roller from the said axis, whereby the lifting plate lifts the web from the nozzle as the roller moves from the first position to the second position.

* * * * *